US009242364B1

(12) United States Patent
Cratty

(10) Patent No.: US 9,242,364 B1
(45) Date of Patent: Jan. 26, 2016

(54) HAND EXTENSION WITH UNIVERSAL CLAMP SYSTEMS

(71) Applicant: Mark James Cratty, New Castle, PA (US)

(72) Inventor: Mark James Cratty, New Castle, PA (US)

( * ) Notice: Subject to any disclaimer, the term of this patent is extended or adjusted under 35 U.S.C. 154(b) by 0 days.

(21) Appl. No.: 14/277,233

(22) Filed: May 14, 2014

Related U.S. Application Data

(60) Provisional application No. 61/823,780, filed on May 15, 2013.

(51) Int. Cl.
*B25G 3/32* (2006.01)
*B25G 1/04* (2006.01)
*A46B 17/02* (2006.01)

(52) U.S. Cl.
CPC . *B25G 1/04* (2013.01); *A46B 17/02* (2013.01); *B25G 1/043* (2013.01)

(58) Field of Classification Search
CPC ..... A46B 7/04; A46B 7/046; B25G 3/00; B25G 3/02; B25G 3/04; B25G 3/24; B25G 3/26; B25G 3/08; B25G 1/04
USPC ..... 16/430, 429, 422, 436; 294/56, 49; 15/143.1, 172, 144.2, 144.3; 81/177.1, 81/177.2, 177.8, 177.75, 489
See application file for complete search history.

(56) References Cited

U.S. PATENT DOCUMENTS 2,367,105 A * 1/1945 Donaldson ..... 294/61
2,792,581 A 5/1957 Woyton
3,357,035 A 12/1967 Ficke
3,413,043 A 11/1968 Bertolina
3,501,993 A * 3/1970 Swenson ..... 411/393
3,984,892 A 10/1976 Kyriakou
4,162,132 A * 7/1979 Kress et al. ..... 403/361
D263,677 S 4/1982 Clark
4,848,818 A * 7/1989 Smith ..... 294/181
4,926,522 A * 5/1990 Wang ..... 16/427
5,220,707 A * 6/1993 Newman et al. ..... 16/429
5,338,128 A * 8/1994 Blanco ..... 403/206
5,460,458 A * 10/1995 Caceres ..... 403/109.5
5,611,325 A * 3/1997 Kudlacek ..... 124/89
5,823,592 A * 10/1998 Kalidindi ..... 294/24
6,116,832 A * 9/2000 Wolf et al. ..... 411/383
6,119,311 A 9/2000 Lavallee
6,199,245 B1 * 3/2001 Blessing ..... 16/430
6,428,066 B1 * 8/2002 Zitz ..... 294/17
6,701,578 B1 * 3/2004 Lu ..... 16/429
6,709,529 B1 * 3/2004 Mekwinski ..... 134/6
6,823,562 B1 * 11/2004 Smith et al. ..... 16/421
6,925,676 B2 * 8/2005 Heavner et al. ..... 15/236.04
7,278,668 B1 * 10/2007 Simmons ..... 294/25
7,516,991 B1 * 4/2009 Cheng ..... 285/404
8,566,999 B1 * 10/2013 Casey ..... 15/146
2003/0126711 A1 * 7/2003 Korenevsky ..... 15/230.11
2009/0223064 A1 * 9/2009 Venderley ..... 30/169
2014/0007365 A1 * 1/2014 Salmon ..... 15/143.1
2015/0007404 A1 * 1/2015 Prosser et al. ..... 15/144.1

* cited by examiner

*Primary Examiner* — Chuck Mah
(74) *Attorney, Agent, or Firm* — RG Patent Consulting, LLC; Rachel Gilboy

(57) ABSTRACT

The hand extension with universal clamp extends the reach of a hand tool. It features a universal clamp to work with virtually any tool. It reduces the need to bend over or work on hands and knees. Further, it decreases the strain and injury often caused by crouching or hunching to work. The device protects clothing from being stained by dirty floors.

20 Claims, 5 Drawing Sheets

HAND EXTENSION WITH UNIVERSAL CLAMP SYSTEMS

CROSS-REFERENCE TO RELATED APPLICATION

The present application is related to and claims priority from prior provisional application Ser. No. 61/823,780, filed May 15, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of tools and more specifically relates to a hand extension with universal clamp device of a tool extension system.

2. Description of the Related Art

Tools are used by individuals in modern society to perform many processes and tasks. Tools are often relatively short in length so they can be stored between uses. When using hand tools, people often have to hunch over or work on their hands and knees. Regularly doing either of these things can result in knee or back problems and general pain and discomfort. Working on hands and knees can also lead to stained and ruined clothing. This is not desirable. A means for using tools over an extended distance is desirable.

Various attempts have been made to solve the above-mentioned problems such as those found in U.S. Pat. Nos. 2,792,581; 3,357,035; D263,677; 3,984,892; 3,413,043; and 6,119,311. This art is representative of tools. None of the above inventions and patents, taken either singly or in combination, is seen to describe the invention as claimed.

Ideally, a hand extension with universal clamp device should provide ease of use and, yet would operate reliably and be manufactured at a modest expense. Thus, a need exists for a reliable tool extension system to avoid the above-mentioned problems.

BRIEF SUMMARY OF THE INVENTION

In view of the foregoing disadvantages inherent in the known tools art, the present invention provides a novel hand extension with universal clamp device of a tool extension system. The general purpose of the present invention, which will be described subsequently in greater detail is to provide a easy means for safely using tools in hard to reach locations.

The hand extension with universal clamp extends the reach of a hand tool. It features a universal clamp to work with any tool. It reduces the need to bend over or work on hands and knees. Further, it decreases the strain and injury often caused by crouching or hunching to work. The present invention protects clothing from being stained by dirty floors.

A tool extension system is disclosed herein, in a preferred embodiment, comprising: a tool extension assembly having a telescopic extension handle (having a proximate end, a distal end, and a handle length), and a coupler end assembly (having a coupler-end-body, a threaded-receiver-end, a tool-handle-receiver-end, and at least one fastener); wherein the tool extension system comprises the tool extension assembly. The tool extension assembly comprises in functional combination the telescopic extension handle and the coupler end assembly.

The parameters of the handle length of the telescopic extension handle are defined by the proximate end and the distal end; wherein the distal end preferably comprises a threaded-extrusion suitable for coupling into the threaded-receiver-end of the coupler end assembly for removable connection thereto. The proximate end of the telescopic extension handle is suitable for holding via a user and may include a gripping means. The telescopic extension handle is suitable for manipulation of the user such that the coupler end assembly holding a tool is able to be used to facilitate a remote use of the tool to perform a task at a distance from the user. This is handy for instances that the user cannot easily reach the object to be worked on.

The coupler end assembly comprises in functional combination the coupler-end-body, the threaded-receiver-end, the tool-handle-receiver-end, and the at least one fastener (serving as a clamping means when tightened). The threaded-receiver-end, and the tool-handle-receiver-end oppose each other; wherein the tool-handle-receiver-end is suitable to receive a handle of the tool. In preferred embodiments the tool-handle-receiver-end comprises a cylindrical profile, alternate embodiments may have different profiles. The working portion of the tool extends out of the tool-handle-receiver-end when coupled such that it can contact the fastener or other work piece.

The at least one fastener is able to couple the handle of the tool substantially within an inner volume of the coupler-end-body, the handle of the tool able to enter into the inner volume of the coupler-end-body, then be tightened via the at least one fastener to secure the tool firmly in position in a condition ready for remote use. The at least one fastener preferably comprises a threaded-fastener threadably moveable in relation to the handle of the tool via apertures located in the tool-handle-receiver-end, however alternate fastening means may be used. The at least one fastener each preferably comprises a bull-nose end for contacting against the tool; the bull-nose end having rubber caps located thereon to prevent damage to the tool (finish). The at least one fastener each preferably comprises a carriage head for hand-tightening of the at least one fastener in relation to the handle of the tool (such that other tools are not necessary for tightening, such that it is more convenient for use).

The telescopic extension handle may comprise aluminum for relative lightweight during use, such that the user can comfortably use the device for extended periods. In this way the user is thereby able to remotely perform tasks at the distance with the tool.

A kit is also disclosed herein including: the telescopic extension handle, a plurality of the coupler end assemblies, and a set of user instructions. Tools may be sold with the present invention.

A method of using a tool extension system is described comprising the steps of: coupling a telescopic extension handle to a coupler end assembly, inserting a handle of a tool into a tool-handle-receiver-end, and turning at least one fastener to couple the tool in position for use, and using the tool to perform a task. The method may further comprise the step of uncoupling the tool and replacing it with another tool or readying the present invention for storage. The device may be fully disassembled for convenient storage.

The present invention holds significant improvements and serves as a hand extension with universal clamp system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, hand extension with universal clamp system (tool extension system), constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to tools and more particularly to a hand extension with universal clamp device as used to improve the ease of using tools in hard to reach (remotely displaced) locations.

Generally speaking, hand extension with universal clamp is a device that significantly extends the reach of other tools. The invention may comprise a cylindrical clamping device that a hand tool can insert into. The present invention may comprise aluminum. The clamp can have two thumbscrews that tighten down into the cylinder to secure a tool in place. The thumbscrews may have rubber caps on the ends to avoid damaging the hand tool. The attachment that the tool inserts into can have female threading at the base in order to connect to a threaded pole. To use, attach virtually any hand tool; such as a roller, screwdriver, trowel, scrapper, or utility knife; onto the threaded pole. Next, insert and tighten the thumbscrews. Use the tool as desired, with the invention acting as an extended handle. The device may be about 6" long and ½" wide.

Figure 1:
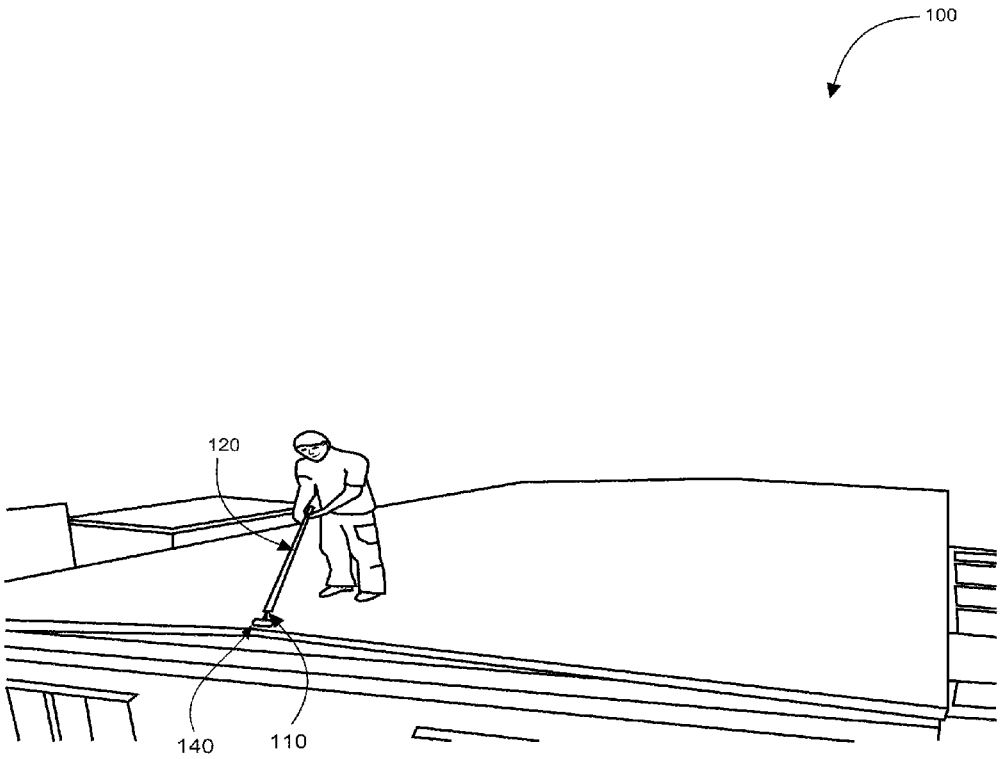
FIG. 1 shows a perspective view illustrating a hand extension with universal clamp device in an in-use condition according to an embodiment of the present invention.
Figure 2:
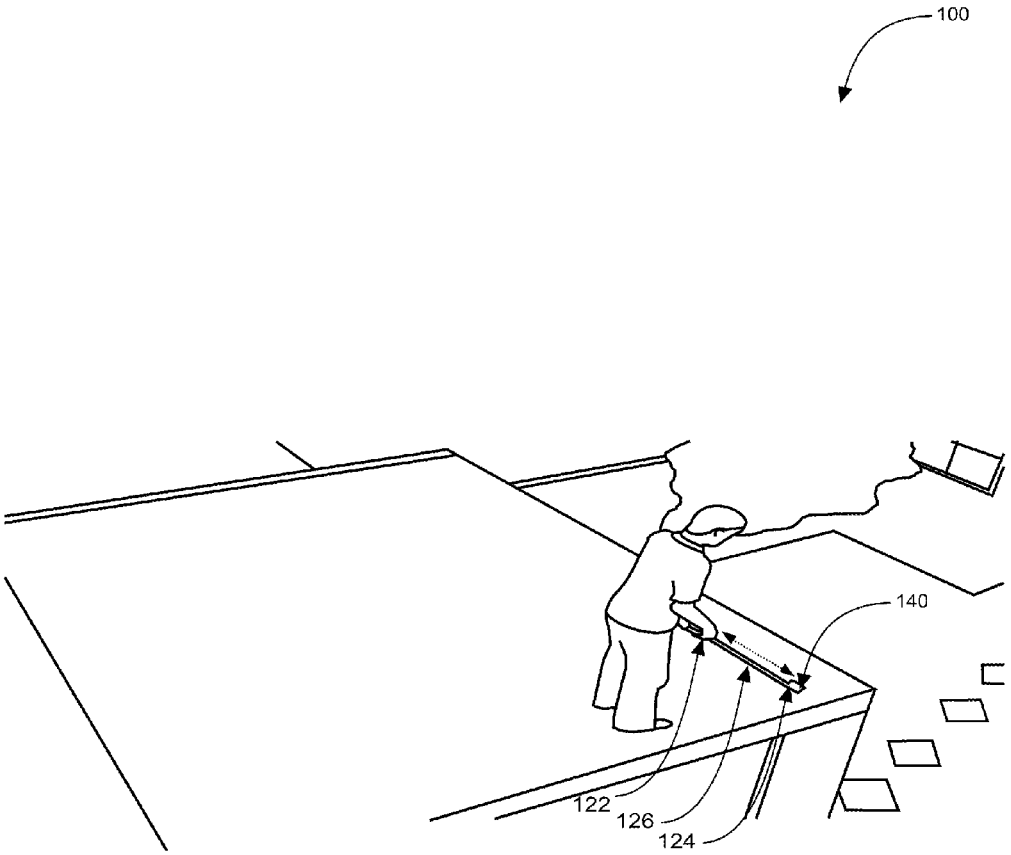
FIG. 2 is a perspective view illustrating the hand extension with universal clamp device in another in-use condition according to an embodiment of the present invention of FIG. 1.

Referring to the drawings by numerals of reference there is shown in FIGS. 1-2, a perspective view illustrating a hand extension with universal clamp device (tool extension assembly 110) of tool extension system 100 in two in-use conditions according to an embodiment of the present invention. Many in-use conditions are envisioned as only exemplary means for use with different tools in different applications are described. The exemplary means are not meant to be limiting in any way.

Tool extension system 100 comprises: tool extension assembly 110 having telescopic extension handle 120 (having proximate end 122, distal end 124, and handle length 126), and coupler end assembly 130 (having coupler-end-body 132, threaded-receiver-end 134, tool-handle-receiver-end 136, and at least one fastener 138). Fastener 138 preferably comprises two of fasteners 138, as shown. As such tool extension system 100 comprises tool extension assembly 110.

Tool extension assembly 110 comprises in functional combination telescopic extension handle 120 and coupler end assembly 130; wherein parameters of handle length 126 of telescopic extension handle 120 are defined by proximate end 122 and distal end 124. Distal end 124 preferably comprises threaded-extrusion 125 suitable for coupling into threaded-receiver-end 134 of coupler end assembly 130 for removable connection thereto. Proximate end 122 of telescopic extension handle 120 is suitable for holding via a user. Telescopic extension handle 120 is suitable for manipulation of the user such that coupler end assembly 130 holding (at least one) tool 140 is able to be used to facilitate a remote use of tool 140 to perform a task at a distance from the user, as shown in both FIGS. 1-2.

Coupler end assembly 130 comprises in functional combination coupler-end-body 132, threaded-receiver-end 134, tool-handle-receiver-end 136, and the at least one fastener 138; wherein threaded-receiver-end 134, and tool-handle-receiver-end 136 oppose each other. Tool-handle-receiver-end 136 is suitable to receive handle 142 of tool 140; wherein the at least one fastener 138 is able to couple handle 142 of tool 140 substantially within inner volume 137 of coupler-end-body 132, handle 142 of tool 140 able to enter into inner volume 137 of coupler-end-body 132, then be tightened via the at least one fastener 138 to secure tool 140 firmly in position in a condition ready for remote use. The user is thereby able to remotely perform tasks at a distance with tool 140.

Figure 3:
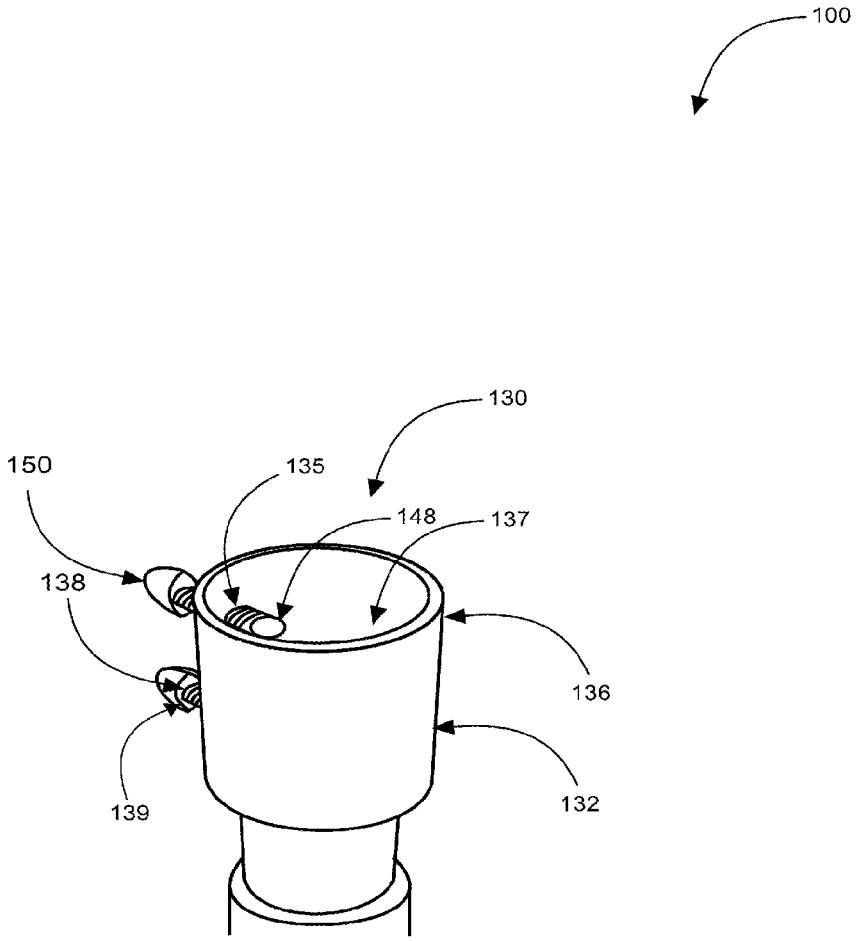
FIG. 3 is a top perspective view illustrating a coupler end assembly of the hand extension with universal clamp device according to an embodiment of the present invention of FIG. 1.
Figure 4:
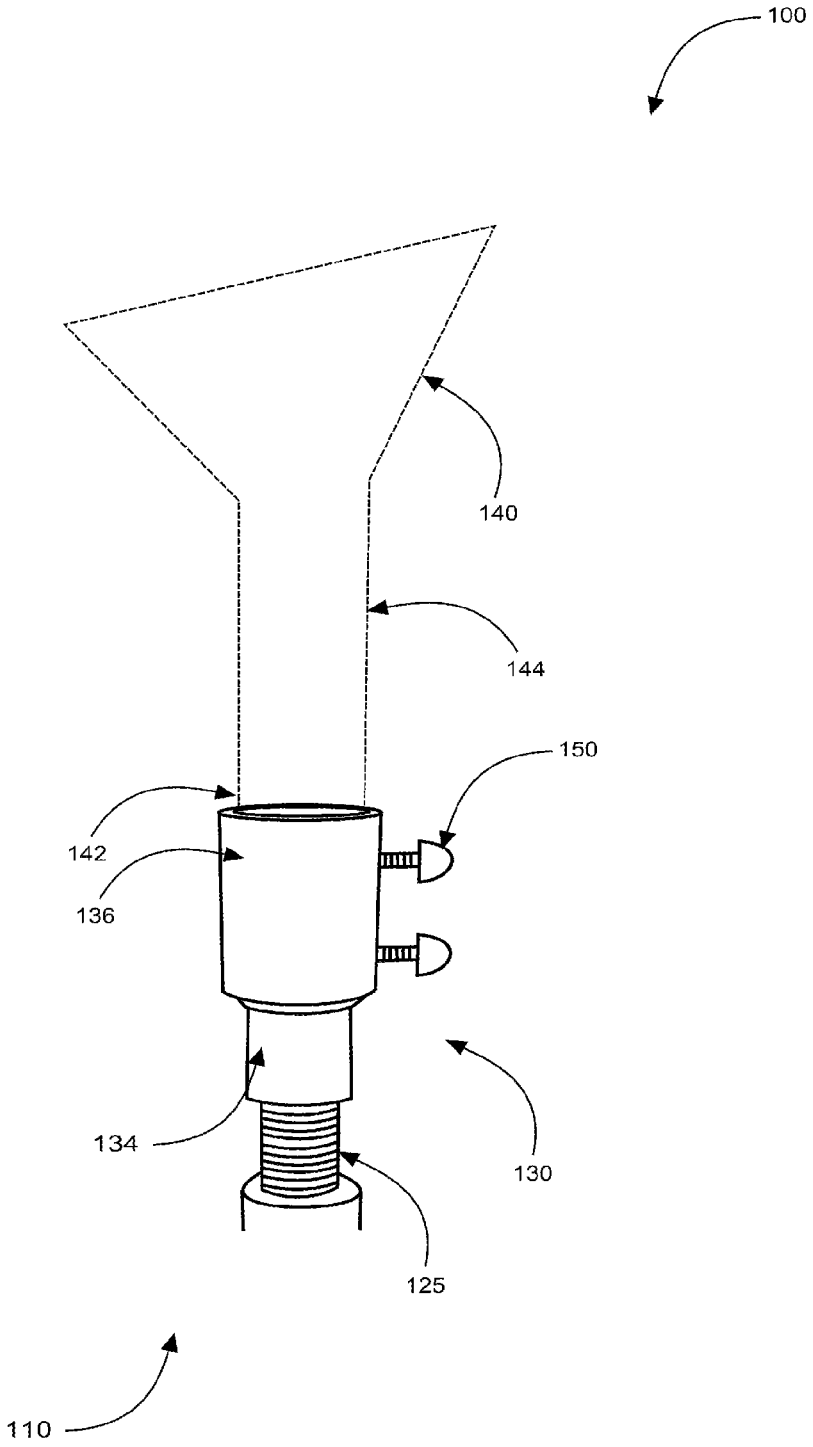
FIG. 4 is a side perspective view illustrating the coupler end assembly according to an embodiment of the present invention of FIG. 1.
Figure 5:
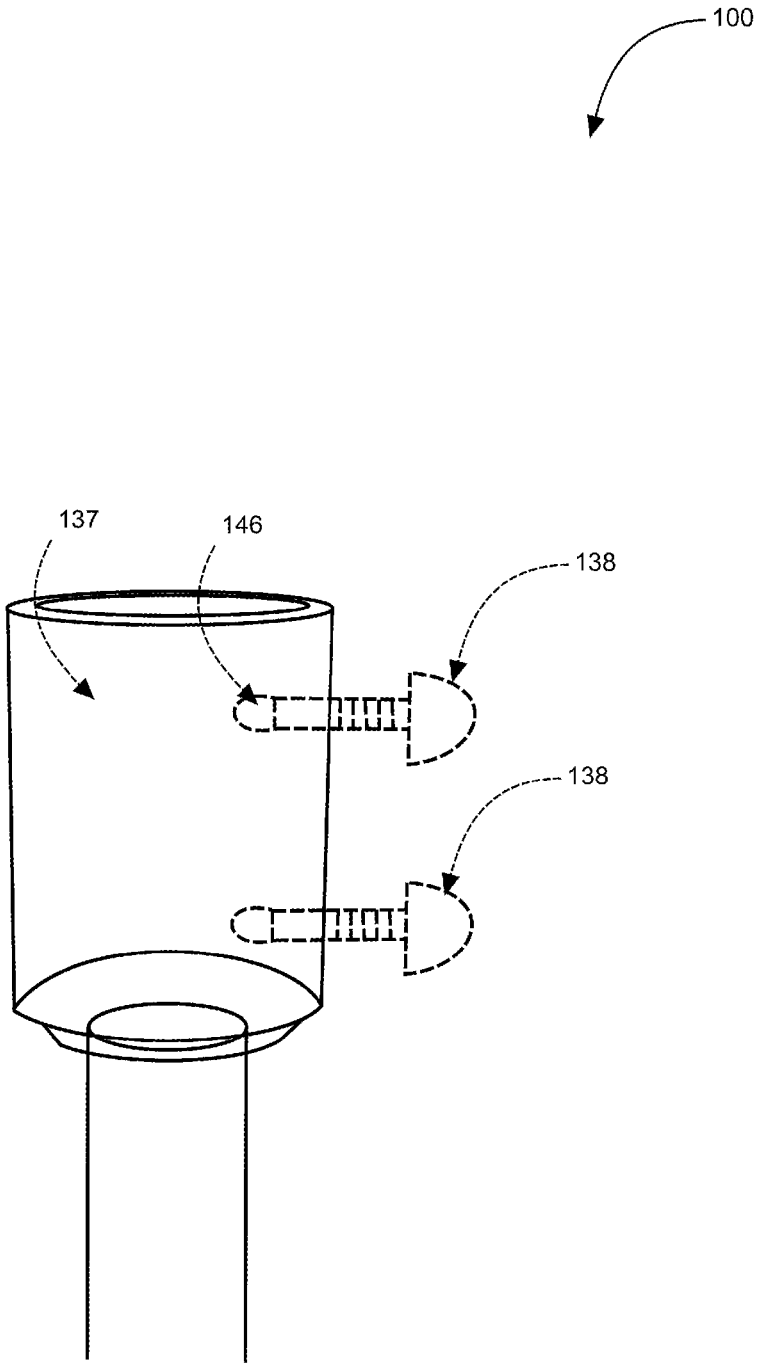
FIG. 5 is another side perspective view illustrating the coupler end assembly of the hand extension with universal clamp system according to an embodiment of the present invention of FIGS. 1 and 4.

Referring now to FIGS. 3-5 showing various perspective views illustrating coupler end assembly 130 of the hand extension with universal clamp device (tool extension assembly 110) of tool extension system 100 according to an embodiment of the present invention of FIG. 1.

The at least one fastener 138 preferably comprises a threaded-fastener 139 threadably moveable in relation to handle 142 of tool 140 (via turning in or out) via apertures 135 located in tool-handle-receiver-end 136; wherein the at least one fastener 138 each preferably comprises bull-nose end 146 for contacting against tool 140; bull-nose end 146 having rubber caps 148 located thereon are used to prevent damage to tool 140. Further, the at least one fastener 138 each preferably comprises carriage head 150 for hand-tightening of the at least one fastener 138 in relation to handle 142 of tool 140.

Tool-handle-receiver-end 136 may comprise a cylindrical profile; wherein working portion 144 of tool 140 extends out of tool-handle-receiver-end 136. Telescopic extension handle

120 preferably comprises aluminum for relative lightweight during use. Other materials may be used for telescopic extension handle 120 such as plastics, composites or the like. It is desirable that the material(s) used be suitably lightweight yet durable such that the invention can be used for extended duration yet not unnecessarily fatiguing the user. Telescopic extension handle 120 may comprise a sectional assembly that is able to be moved in relation to a preceding section to provide telescoping means. Those with ordinary skill in the art will now appreciate that upon reading this specification and by their understanding the art of mechanical telescoping means as described herein, methods of telescoping will be understood by those knowledgeable in such art. The sectional assembly may comprise detents for holding steady the sectional assembly when set at a user-defined positioning.

Handle 142 of tool 140 comprises a cylindrical-handle-profile in preferred embodiments; alternate embodiments may comprise a non-cylindrical-handle-profile (such as square, or rectangular, oval or the like.

Tool 140 may comprise a scraper, a trowel, a roller paint brush, a screwdriver, a utility knife. Tool 140 may comprise other suitable tools not mentioned. Tool 140 should be generally understood to refer to any handheld tool 140.

A kit may include: telescopic extension handle 120, a plurality of the coupler end assemblies 130 (of various profiles if desired for different applications of use), and a set of user instructions.

A method of using a tool extension system 100 comprises the steps of: coupling telescopic extension handle 120 to coupler end assembly 130, inserting handle 142 of tool 140 into tool-handle-receiver-end 136, and turning at least one fastener 138 (for example threaded-fastener 139) to couple tool 140 in position for use, and using tool 140 to perform a task. The method may further comprise the step of uncoupling tool 140 and replacing it with another tool or readying the present invention for storage. The device may be fully disassembled for convenient storage.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A tool extension system comprising:

a) a tool extension assembly having;

i) a telescopic extension tool handle having;

a sectional assembly comprising at least two sections, wherein said sectional assembly includes;

a user-proximate end comprising a first threaded-extrusion;

a threaded-receiver-distal end comprising a second threaded-extrusion adapted to removably retain a tool-holding-coupler end-assembly thereon;

a tool handle length; and a tool handle-profile; and ii) a tool-holding-coupler end-assembly adapted to releasably attach to said second threaded-extrusion of said threaded-receiver-distal end, said tool-holding-coupler end-assembly having;

a coupler-end-body having an inner volume, wherein said coupler-end-body includes;

a threaded-receiver-end;

a tool-handle-receiver-end comprising an aperture adapted to releasable retain a tool handle therein; and at least one fastener releasably connected to said threaded-receiver-end and comprising a clamp; and b) a tool adapted to be releasably connected to said tool-holding-coupler end-assembly, said tool comprising;

a working portion; and a handle adapted to be releasably connected to said tool-handle-receiver-end of said coupler-end-body;

c) wherein said second threaded-extrusion is structured and arranged to directly removably-couple into said threaded-receiver-end of said coupler end assembly;

d) wherein said tool extension system comprises said tool extension assembly;

e) wherein said tool extension assembly comprises in direct-mating functional combination of said telescopic extension handle and said coupler end assembly;

f) wherein parameters of said handle length of said telescopic extension handle are defined by said user-proximate end structured and arranged with said first threaded-extrusion and said threaded-receiver-distal end structured and arranged with said second threaded-extrusion;

g) wherein said threaded-receiver-distal end comprises a said second threaded-extrusion structured and arranged with said handle-profile suitable for coupling into said threaded-receiver-end of said tool-holding coupler end-assembly for threadedly-removable connection thereto;

h) wherein said user-proximate end of said telescopic extension handle is structured and arranged with said handle-profile and further structured and arranged with said first threaded-extrusion suitable for holding via by a user;

i) wherein said telescopic extension handle is structured and arranged with said tool-coupler end assembly and further structured and arranged with said tool whereby said user can manipulate suitable for manipulation of by said user such that said tool-coupler end assembly holding a said tool is able to be used to facilitate a remote use of said tool to perform a task at a distance from said user;

j) wherein said coupler end assembly comprises in functional combination said coupler-end-body, said threaded-receiver-end, said tool-handle-receiver-end, and said at least one fastener;

k) wherein said threaded-receiver-end, and said tool-handle-receiver-end oppose each other;

l) wherein said tool-handle-receiver-end is structured and arranged to mate with and receive suitable to receive a said handle of said tool;

m) wherein said at least one fastener is structured and arranged with said tool-handle-receiver-end able to couple said handle of said tool substantially within an said inner volume of said coupler-end-body, and said handle of said tool is further structured and arranged able to enter into said inner volume of said coupler-end-body, then be tightened via whereby said at least one fastener to secures said tool firmly in position in a condition ready for remote use; and n) such that a user is able to remotely perform tasks at said distance with said tool.

2. The tool extension system of claim 1 wherein said at least one fastener comprises a threaded-fastener threadably moveable structured and arranged with said aperture to control movement of said at least one fastener in relation to said handle of said tool via apertures located in said tool-handle-receiver-end.

3. The tool extension system of claim 2 wherein each said at least one fastener each comprises a bull-nose end structured and arranged with said aperture to contact for contacting against said tool, said bull-nose end having rubber caps located thereon to prevent damage to said tool.

4. The tool extension system of claim 1 wherein each said at least one fastener each comprises a carriage head structured and arranged with said aperture for hand-tightening of said at least one fastener in relation to said handle of said tool.

5. The tool extension system of claim 1 wherein said tool-handle-receiver-end comprises a cylindrical profile.

6. The tool extension system of claim 1 wherein a working portion of said tool extends out of said tool-handle-receiver-end.

7. The tool extension system of claim 1 wherein said telescopic extension handle comprises aluminum for relative lightweight during use.

8. The tool extension system of claim 7 wherein said telescopic extension handle comprises a said sectional assembly structured and arranged with said user-proximate end and further structured and arranged with said threaded-receiver-distal end and further structured and arranged with said at least two sections such that said user-proximate end moves relative to said threaded-receiver-distal end that is able to be moved in relation to a preceeding section to provide telescoping means.

9. The tool extension system of claim 1 wherein said handle of said tool comprises a cylindrical-handle-profile.

10. The tool extension system of claim 1 wherein said handle of said tool comprises a noncylindrical-handle-profile.

11. The tool extension system of claim 9 wherein said tool comprises a scraper.

12. The tool extension system of claim 9 wherein said tool comprises a trowel.

13. The tool extension system of claim 9 wherein said tool comprises a roller paint brush.

14. The tool extension system of claim 9 wherein said tool comprises a screwdriver.

15. The tool extension system of claim 10 wherein said tool comprises a utility knife.

16. The tool extension system of claim 8 wherein said sectional assembly comprises detents for holding steady said sectional assembly when at a user-defined positioning.

17. A tool extension system comprising:

a) a tool extension assembly having;

i) a telescopic extension tool handle having;

a sectional assembly comprising at least two sections, wherein said sectional assembly includes;

a user-proximate end comprising a first threaded-extrusion;

a threaded-receiver-distal end comprising a second threaded-extrusion adapted to removably retain a tool-holding-coupler end-assembly thereon;

a tool handle length; and a tool handle-profile; and ii) a tool-holding-coupler end-assembly adapted to releasably attach to said second threaded-extrusion of said threaded-receiver-distal end, said tool-holding-coupler end-assembly having;

a coupler-end-body having an inner volume, wherein said coupler-end-body includes;

a threaded-receiver-end;

a tool-handle-receiver-end comprising an aperture adapted to releasable retain a tool handle therein; and at least one fastener releasably connected to said threaded-receiver-end and comprising a clamp; and b) a tool adapted to be releasably connected to said tool-holding-coupler end-assembly, said tool comprising;

a working portion; and a handle adapted to be releasably connected to said tool-handle-receiver-end of said coupler-end-body;

c) wherein said second threaded-extrusion is structured and arranged to directly removably-couple into said threaded-receiver-end of said coupler end assembly;

d) wherein said tool extension system comprises said tool extension assembly;

e) wherein said tool extension assembly comprises in direct-mating functional combination of said telescopic extension handle and said coupler end assembly;

f) wherein parameters of said handle length of said telescopic extension handle are defined by said user-proximate end structured and arranged with said first threaded-extrusion and said threaded-receiver-distal end structured and arranged with said second threaded-extrusion;

g) wherein said threaded-receiver-distal end comprises a said second threaded-extrusion structured and arranged with said handle-profile suitable for coupling into said threaded-receiver-end of said tool-holding coupler end-assembly for threadedly-removable connection thereto;

h) wherein said user-proximate end of said telescopic extension handle is structured and arranged with said handle-profile and further structured and arranged with said first threaded-extrusion suitable for holding via by a user;

i) wherein said telescopic extension handle is structured and arranged with said tool-coupler end assembly and further structured and arranged with said tool whereby said user can manipulate suitable for manipulation of by said user such that said tool-coupler end assembly holding a said tool is able to be used to facilitate a remote use of said tool to perform a task at a distance from said user;

j) wherein said coupler end assembly comprises in functional combination said coupler-end-body, said threaded-receiver-end, said tool-handle-receiver-end, and said at least one fastener;

k) wherein said threaded-receiver-end, and said tool-handle-receiver-end oppose each other;

l) wherein said tool-handle-receiver-end is structured and arranged to mate with and receive suitable to receive a said handle of said tool;

m) wherein said tool-handle-receiver-end comprises a cylindrical profile;

n) wherein a working portion of said tool extends out of said tool-handle-receiver-end;

o) wherein said at least one fastener is able to couple said handle of said tool substantially within an inner volume of said coupler-end-body, said handle of said tool able to enter into said inner volume of said coupler-end-body, then be tightened via said at least one fastener to secure said tool firmly in position in a condition ready for remote use;

p) wherein said at least one fastener comprises a threaded-fastener threadably moveable in relation to said handle of said tool via apertures located in said toolhandle-receiver-end;

q) wherein said at least one fastener each comprises a bull-nose end for contacting against said tool, said bull-nose end having rubber caps located thereon to prevent damage to said tool;

r) wherein said at least one fastener each comprises a carriage head for hand-tightening of said at least one fastener in relation to said handle of said tool;

s) wherein said telescopic extension handle comprises aluminum for relative lightweight during use; and t) such that a user is able to remotely perform tasks at said distance with said tool.

18. The tool extension system of claim 17 further comprising a kit including:

a) said telescopic extension handle;

b) a plurality of said coupler end assemblies; and c) a set of user instructions.

19. A method of using a tool extension system of claim 17 comprising the steps of:

a) coupling a telescopic extension handle to a coupler end assembly;

b) inserting a handle of a tool into a tool-handle-receiver-end;

c) turning at least one fastener to couple said tool in position for use; and d) using said tool.

20. The method of claim 19 further comprising the step of uncoupling said tool.

* * * * *